US010274864B2

(12) United States Patent
Tsuru

(10) Patent No.: US 10,274,864 B2
(45) Date of Patent: Apr. 30, 2019

(54) IMAGE FORMING APPARATUS FOR MEASURING REFERENCE VALUE OF TONER CONCENTRATION

(71) Applicant: KONICA MINOLTA, INC., Chiyoda-ku, Tokyo (JP)

(72) Inventor: Kenji Tsuru, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/908,293

(22) Filed: Feb. 28, 2018

(65) Prior Publication Data

US 2018/0259878 A1 Sep. 13, 2018

(30) Foreign Application Priority Data

Mar. 7, 2017 (JP) ..... 2017-042587

(51) Int. Cl.
*G03G 15/08* (2006.01)
*G03G 15/00* (2006.01)

(52) U.S. Cl.
CPC ..... *G03G 15/0849* (2013.01); *G03G 15/0856* (2013.01); *G03G 15/0858* (2013.01); *G03G 15/0893* (2013.01); *G03G 15/50* (2013.01)

(58) Field of Classification Search
CPC ..... G03G 15/0858; G03G 15/0831
See application file for complete search history.

(56) References Cited

U.S. PATENT DOCUMENTS 5,031,123 A * 7/1991 Narukawa ..... G03G 15/0849 399/254
5,065,190 A 11/1991 Nakagama et al.

FOREIGN PATENT DOCUMENTS

JP H03-123376 A 5/1991
JP 2014-106344 A 6/2014
JP 2014-126737 A 7/2014

* cited by examiner

*Primary Examiner* — Clayton E. LaBalle
*Assistant Examiner* — Jas A Sanghera
(74) *Attorney, Agent, or Firm* — Buchanan Ingersoll & Rooney PC

(57) ABSTRACT

A developing device of an image forming apparatus includes a casing, two-component developer accommodated in the casing, and a stirring screw for conveying and stirring the developer in the casing by rotation in a predetermined direction. The image forming apparatus includes a toner concentration sensor that outputs a value indicative of the toner concentration of the developer in the casing. The image forming apparatus determines whether or not the developer in the casing has become uniform, based on the amount of change per unit time of the output value of the toner concentration sensor, acquired after the stirring of the developer in the casing by the stirring screw is started. It is possible to appropriately measure the reference value of the toner concentration.

9 Claims, 19 Drawing Sheets

IMAGE FORMING APPARATUS FOR MEASURING REFERENCE VALUE OF TONER CONCENTRATION

The entire disclosure of Japanese patent application No. 2017-42587 filed on Mar. 7, 2017, is incorporated herein by reference in its entirety.

BACKGROUND

Technological Field

The present invention relates to an image forming apparatus and a control program for an image forming apparatus. More specifically, the present invention relates to an image forming apparatus and a control program for the image forming apparatus, provided with a developing device.

Description of the Related Art

As an electrophotographic image forming apparatus, there is an MFP (Multi Function Peripheral) having a scanner function, a facsimile function, a copying function, a function as a printer, a data communication function, and a server function. Further, as an electrophotographic image forming apparatus, there are a facsimile apparatus, a copying machine, a printer, and the like.

In general, an image forming apparatus forms the toner image by developing an electrostatic latent image formed on an image carrier with a developing device. The image forming apparatus transfers this toner image onto a sheet. Thereafter, the image forming apparatus fixes the toner image on the sheet by using a fixing device. As a result, an image is formed on the sheet. There is also an image forming apparatus in which an electrostatic latent image on the surface of a photoreceptor is developed using a developing device to form the toner image, and the toner image is transferred onto the intermediate transfer belt by using a primary transfer roller. In such an image forming apparatus, a secondary transfer roller is used to secondarily transfer the toner image on the intermediate transfer belt to paper. In this case, the photoreceptor and the intermediate transfer belt serve as image carriers.

In the case where two-component developer is used as the developer, the developer in the developing device contains toner and magnetic carrier. Since the toner in the developing device is consumed every time the image forming apparatus performs printing, the toner concentration in the developing device is lowered as the number of printed sheets of the image forming apparatus increases. Therefore, the image forming apparatus measures the toner concentration in the developing device at a predetermined timing. When the measured toner concentration is lower than the reference value of the toner concentration, the toner bottle arranged in the image forming apparatus replenishes the toner in the developing device. This reference value of the toner concentration is for judging whether or not to replenish the toner to the developing device.

In recent years, image forming apparatuses are shipped in a state in which developer set at an appropriate concentration ratio is prefilled in a developing device. There is a circumstance in image forming apparatuses that the sensitivities of the toner concentration sensors for measuring the toner concentration are slightly different among image forming apparatuses. Therefore, the reference value of the toner concentration is set by the image forming apparatus itself performing a predetermined operation.

The toner concentration in the newly unused developing device is kept in an optimum state. On the other hand, if the toner is consumed even in a very small amount in the developing device, it is impossible to accurately set the reference value of the toner concentration. A reference value of toner concentration is set when the image forming apparatus is produced, or when a new unused developing device is installed in the image forming apparatus, in order to use the toner concentration in the newly unused developing device as the reference value of the toner concentration. Generally, the reference value of the toner concentration is set in the following cases. That is, the reference value of the toner concentration is set when a new developing device is set in the image forming apparatus in the production line of the image forming apparatus. Alternatively, the reference value of the toner concentration is set when the power supply of the image forming apparatus is first turned on after the developing device of the image forming apparatus is replaced with a new unused one.

An image forming apparatus rotates the screw in the developing device when setting the reference value of the toner concentration. As a result, the image forming apparatus performs preliminary stirring (idle stirring without development) of the developer in the developing device. The image forming apparatus measures the subsequent toner concentration in the developing device and sets the measured value as the reference value of the toner concentration. Hereinafter, the operation of setting the reference value of the toner concentration performed by the image forming apparatus may be referred to as TCR (Toner Carrier Ratio) automatic adjustment.

It is necessary for the reference value of the toner concentration to be measured in a state in which the developer is uniformly stirred. According to the conventional image forming apparatus, at the time of automatic TCR adjustment, the toner concentration is measured after preliminarily stirring the developer in the developing device for a predetermined time set in advance.

Techniques related to measurement of toner concentration in a developing device are disclosed in the following documents 1 to 3, for example. The following document 1 discloses a technique of judging that the developer has a bias when the output value of the toner concentration sensor is in an abnormal range and stirring the developing device.

Document 2 below discloses a technique for calculating the amount of change between the toner concentration detected during stirring and the toner concentration detected after stirring for a certain period of time. When the amount of change is out of a predetermined range, the toner concentration in a stable state is estimated, and set as the TCR reference value.

The following document 3 discloses a technique for acquiring the toner concentration sensor reference value for each speed, and selecting a reference value for each machine.

DOCUMENT(S)

Document(s) Related to Patent(s)

[Document 1] Japanese Unexamined Patent Publication No. 2014-126737

[Document 2] Japanese Unexamined Patent Publication No. (Hei) 3-123376

[Document 3] Japanese Unexamined Patent Publication No. 2014-106344

Even if the developing device is unused, the state of the developer in the developing device varies greatly among individuals depending on the storage condition of the developing device and the like. Conventionally, the time for preliminary stirring the developer in the developing device was always constant, regardless of the state of the developer in the developing device. For this reason, it is unclear whether the toner concentration in the developing device after the preliminary stirring is uniform or not. Therefore, according to the conventional technique, it is impossible to appropriately measure the reference value of the toner concentration.

That is, it may be assumed that there is a large bias in the concentration of the toner in the developing device. In this case, even after preliminarily stirring the developer in the developing device for the set time, the unevenness of the toner concentration in the developing device can not be eliminated. Therefore, it was impossible to properly set the reference value of the toner concentration. Further, in order to avoid such a problem, it is conceivable to set the time of preliminary stirring to be long. However, by this method, problems such as a decrease in productivity of the image forming apparatus, an increase in setup time of the image forming apparatus, or possibility of turnover by the cleaner blade of the intermediate transfer belt occur.

On the other hand, when the concentration of the toner in the developing device is relatively uniform, the toner concentration in the developing device becomes uniform before the set preliminary stirring time elapses. For this reason, problems such as reduction in productivity of the image forming apparatus due to unnecessarily stirring for a long period of time, increase in setup time of the image forming apparatus, possibility of turnover by the cleaner blade of the intermediate transfer belt occur.

SUMMARY

An object of the present invention is to provide an image forming apparatus and a control program for an image forming apparatus capable of appropriately measuring a reference value of toner concentration.

To achieve at least one of the abovementioned objects, according to an aspect of the present invention, an image forming apparatus reflecting one aspect of the present invention comprises a developing device, wherein the developing device comprising a casing, two-component developer accommodated in the casing, and a screw that conveys the developer in the casing in a predetermined direction and stirs the developer in the casing by rotating the screw, wherein the image forming apparatus comprising a sensor that outputs a value indicative of toner concentration of the developer in the casing, and a hardware processor that judges whether or not the developer in the casing has become uniform, based on an amount of change per unit time of the output value of the sensor, acquired after start of stirring the developer in the casing by the screw.

According to another aspect of the present invention, a non-transitory computer-readable recording medium storing a controlling program for an image forming apparatus having a developing device and a sensor, wherein the developing device includes a casing, two-component developer accommodated in the casing, and a screw that conveys and stirs the developer in the casing in a predetermined direction by rotating, the sensor outputs a value indicative of toner concentration of the developer in the casing and the program causing a computer to execute judging whether or not the developer in the casing is uniform, based on an amount of change per unit time of an output value of the sensor, acquired after starting stirring of the developer in the casing by the screw.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

In the following embodiments, a case where the image forming apparatus is an MFP will be described. The image forming apparatus may be a MFP, a facsimile machine, a copying machine, a printer, or the like.

First Embodiment

First, the configuration of the image forming apparatus according to the present embodiment will be described.

Figure 1:
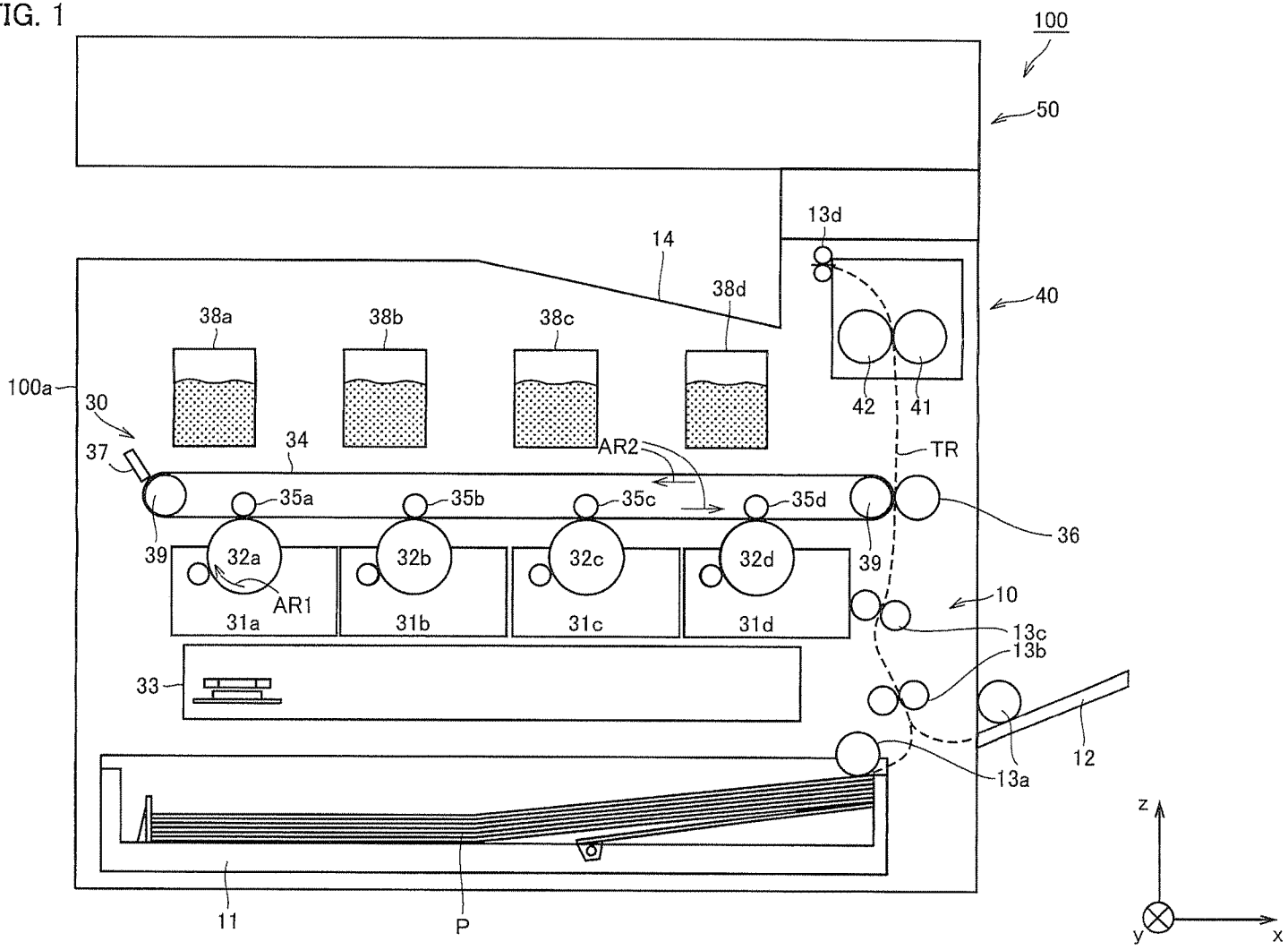
FIG. 1 is a cross-sectional view showing a configuration of an image forming apparatus 100 according to a first embodiment of the present invention.
Figure 2:
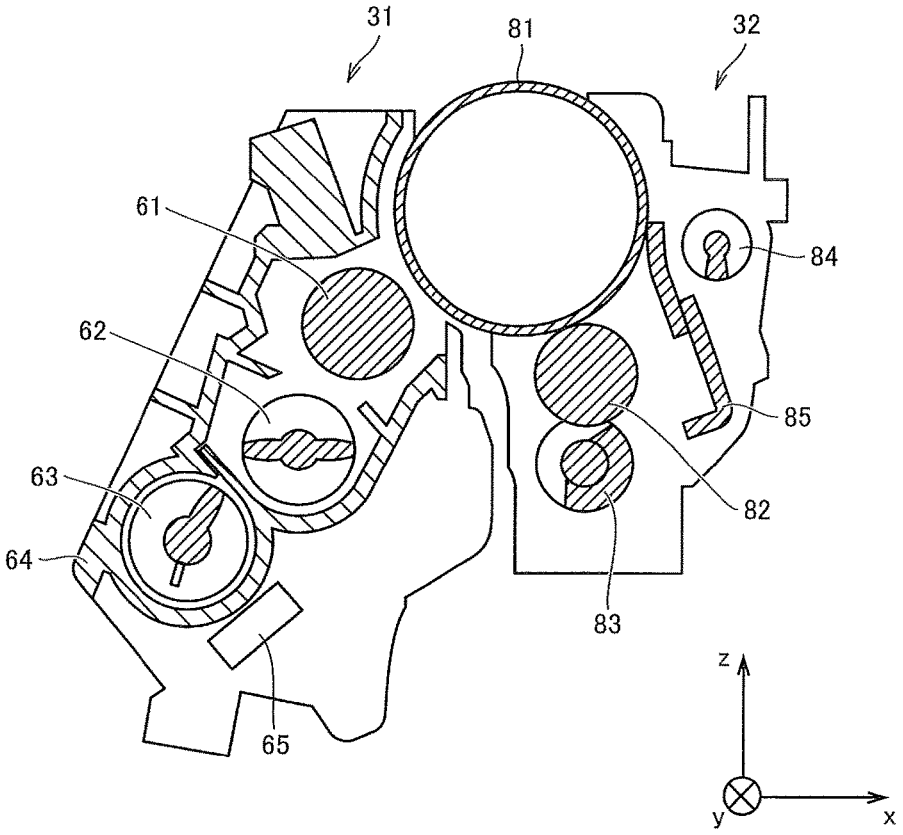
FIG. 2 is an enlarged sectional view of an arbitrary developing unit 31 and a photoreceptor unit 32 in FIG. 1.

FIG. 1 is a cross-sectional view showing a configuration of an image forming apparatus 100, according to a first embodiment of the present invention. FIG. 2 is an enlarged sectional view of an arbitrary developing unit 31 and a photoreceptor unit 32 in FIG. 1.

With reference to FIG. 1 and FIG. 2, the image forming apparatus 100 in the present embodiment is an MFP. The image forming apparatus 100 mainly includes a sheet conveying unit 10, the toner image forming unit 30, a fixing device 40, and a scanner unit 50.

The sheet conveying unit 10 includes a sheet feed tray 11, a manual feed tray 12, a sheet feed roller 13*a*, conveyance rollers 13*b* and 13*c*, a sheet discharge roller 13*d*, and a sheet discharge tray 14. The paper feed tray 11 is provided at the bottom of the main body 100*a* of the image forming apparatus and accommodates the paper P for forming images. A plurality of paper feed trays 11 may be used. The manual feed tray 12 is provided on the side surface of the image forming apparatus main body 100*a* and is for arranging manual feed paper. The paper feed roller 13*a* is provided between the paper feed tray 11 and the manual feed tray 12, and the conveying path TR. Each of the sheet feed rollers 13*b* and 13*c* is provided along the conveying path TR. The discharge roller 13*d* is provided at the most downstream portion of the conveying path TR. The sheet discharge tray 14 is provided at the top of the image forming apparatus main body 100*a*.

The toner image forming unit 30 synthesizes images of four colors of Y (yellow), M (magenta), C (cyan), and K (black) in a so-called tandem system, and transfers the toner image to the paper. The toner image forming unit 30 includes developing units 31*a*, 31*b*, 31*c*, and 31*d* (examples of developing devices) of Y, M, C, and K colors. The toner image forming unit 30 includes photoreceptor units 32*a*, 32*b*, 32*c*, and 32*d* of Y, M, C, and K colors. The toner image forming unit 30 includes an exposure device (laser unit) 33, an intermediate transfer belt 34, primary transfer rollers 35*a*, 35*b*, 35*c*, and 35*d*. The toner image forming unit 30 includes a secondary transfer roller 36, a cleaning device 37, toner bottles 38*a*, 38*b*, 38*c*, and 38*d* of Y, M, C, and K colors, a rotating roller 39, and the like.

In the present specification, the developing units 31*a*, 31*b*, 31*c*, and 31*d* may be collectively referred to as a developing unit 31, and the photoreceptor units 32*a*, 32*b*, 32*c*, and 32*d* may be collectively referred to as a photoreceptor unit 32.

The developing unit 31 and the photoreceptor unit 32 of each color constitute imaging units of respective colors, and are juxtaposed immediately below the intermediate transfer belt 34. The photoreceptor unit 32 includes a photoreceptor drum 81, a charging roller 82, a cleaning roller 83, a charge eliminating device 84, and a cleaning blade 85.

The photoreceptor drum 81 has photoconductivity and is cylindrical. The photoreceptor drum 81 is rotationally driven in a direction indicated by an arrow AR1 in FIG. 1. A charging roller 82, a developing unit 31, a charge eliminating device 84, and a cleaning blade 85 are arranged around the photoreceptor drum 81. The charging roller 82 charges the photoreceptor drum 81, and the surface potential of the photoreceptor drum 81 is set to a predetermined charging potential by the charging roller 82. The developing unit 31 develops the electrostatic latent image formed on the photoreceptor drum 81. The cleaning blade 85 removes the waste toner on the photoreceptor drum 81. The waste toner recovered by the cleaning blade 85 is collected by a waste toner screw (not shown). The cleaning roller 83 is disposed in the vicinity of the charging roller 82. The cleaning roller 83 removes the waste toner of the charging roller 82.

The exposure device 33 is provided under the developing unit 31 and the photoreceptor unit 32 of each color. The intermediate transfer belt 34 is annular, and is laid across rotating rollers 39. The intermediate transfer belt 34 is rotationally driven in a direction indicated by an arrow AR2 in FIG. 1. Each of the primary transfer rollers 35*a*, 35*b*, 35*c*, and 35*d* faces each of the photoreceptor drums 81 of the photoreceptor units 32 of the respective colors with the intermediate transfer belt 34 interposed therebetween. The secondary transfer roller 36 is in contact with the intermediate transfer belt 34 in the conveying path TR. The interval between the secondary transfer roller 36 and the intermediate transfer belt 34 can be adjusted by a pressure contacting and separating mechanism (not shown). The cleaning device 37 is provided in the vicinity of the intermediate transfer belt 34.

The fixing device 40 includes a heating roller 41 and a pressure roller 42. The fixing device 40 fixes the toner image on the sheet by conveying it along the conveying path TR while gripping the sheet bearing the toner image by the nip portion between the heating roller 41 and the pressure roller 42.

The scanner unit 50 is installed on the upper portion of the image forming apparatus main body 100*a*, and reads the image of the original.

The image forming apparatus 100 receives a print request or a copy request of the document image read by the scanner unit 114. Then, the sheet conveying unit 10 feeds the sheet P accommodated in the sheet feed tray 11 or the manually fed sheet placed on the manual feed tray 12 to the conveying path TR, by the sheet feed roller 13*a*. The sheet conveying unit 10 conveys the sheet along the conveying path TR by the conveying rollers 13*b* and 13*c* (timing rollers), and guides the sheet to between the intermediate transfer belt 34 and the secondary transfer roller 36 at a predetermined timing.

The exposure device 33 irradiates an exposure beam based on the image information that was requested to be printed or copied onto the photoreceptor drum 81 charged to a predetermined charging potential by the charging roller 82. An LD (Laser Diodes) is mainly used as a light source of this exposure beam. The scanning direction of this LD is the same direction as the rotation axis direction of the photoreceptor drum 81 and is called the main scanning direction. In order to move the exposing beam in the main scanning direction, a mirror (not shown) is rotated to utilize reflection of the beam. This mirror is called a polygon mirror, and a motor (not shown) for rotating the mirror is called a polygon motor.

The surface potential of the portion of the surface of the photoreceptor drum 81 irradiated with the exposing beam decreases to a predetermined level, due to the photoconductivity of the photoreceptor drum 81. As the surface potential of the surface of the photoreceptor drum 81 changes, an electrostatic latent image is formed on the surface of the photoreceptor drum 81 which is exposed by the exposure device 33, based on the image requested to be printed or copied. The developing unit 31 develops the electrostatic latent image formed on the surface of the photoreceptor drum 81.

Each of the primary transfer rollers 35*a*, 35*b*, 35*c*, and 35*d* sequentially transfers the toner image formed on the photoreceptor drum 81 of the photoreceptor unit 32 of each color, onto the surface of the intermediate transfer belt 34 (primary transfer). On the surface of the intermediate transfer belt 34, the toner image in which toner images of respective colors are synthesized is formed.

The charge eliminating device 84 neutralizes the surface of the photoreceptor drum 81, after the primary transfer. The cleaning blade 85 removes the toner remaining on the photoreceptor drum 81, which was not transferred to the intermediate transfer belt 34.

The rotating rollers 39 rotationally drives the intermediate transfer belt 34. As a result, the toner image formed on the surface of the intermediate transfer belt 34 is conveyed to a position facing the secondary transfer roller 36. The secondary transfer roller 36 transfers the toner image formed on the surface of the intermediate transfer belt 34 to a sheet conveyed between the intermediate transfer belt 34 and the secondary transfer roller 36.

The cleaning device 37 removes and collects the toner remaining on the surface of the intermediate transfer belt 34 which was not transferred onto the paper.

The sheet to which the toner image is transferred is guided to the fixing device 40. The fixing device 40 fixes the toner image on the sheet. Thereafter, the sheet conveying unit 10 discharges the sheet on which the toner image has been fixed, onto the sheet discharge tray 14, by the sheet discharge roller 13*d*.

When the amount of toner in the developing unit 31 decreases due to the image formation, the toner stored in the YMCK toner bottles 38*a*, 38*b*, 38*c*, and 38*d* having the appropriate color is supplied to the developing unit 31. When the toner inside one of the toner bottles 38*a*, 38*b*, 38*c*, and 38*d* runs out, the user replaces the toner bottle. As a result, the toner is continuously supplied to the image forming apparatus 100.

Figure 3:
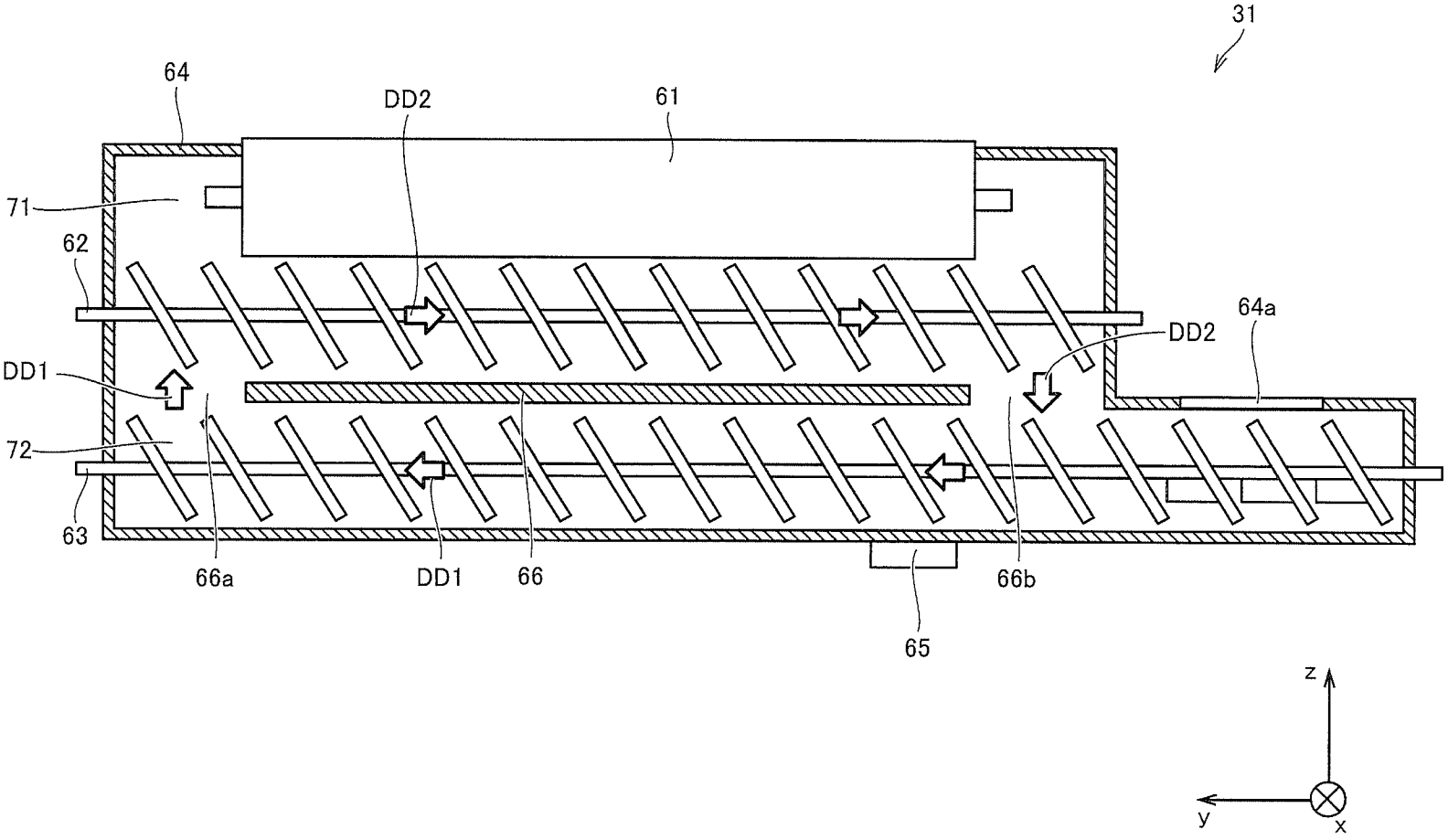
FIG. 3 is a cross-sectional view of the developing unit 31 in a case where the stirring screw 63 is cut along a section including a rotation axis thereof.

FIG. 3 is a cross-sectional view of the developing unit 31 in a case where the stirring screw 63 is cut along a section including a rotation axis thereof. In FIG. 3, the developing sleeve 61 is shown for convenience of explanation, and the developer accommodated in the casing 64 is omitted.

The developing unit 31 will be described with reference to FIGS. 2 and 3. The developing unit 31 includes a developing sleeve 61, a supply screw 62, a stirring screw 63 (an example of a screw), a casing 64, a toner concentration sensor 65 (an example of a sensor), and a partition wall 66.

The developer is accommodated in the casing 64. This developer is two-component developer and contains the toner and the magnetic carrier.

The interior of the casing 64 is partitioned into a conveying path 71 and a conveying path 72 by a partition wall 66. Each of the conveying paths 71 and 72 and the partition wall 66 extends in the direction along the rotation axis of the developing sleeve 61. The conveying path 71 is provided closer to the developing sleeve 61 than the conveying path 72. The rotation axes of the photoreceptor drum 81, the developing sleeve 61, the supply screw 62, and the stirring screw 63 are parallel to each other. In the vicinity of the right end portion of the casing 64 in FIG. 3, a supply port 64*a* for supplying toner into the casing 64 is provided.

The stirring screw 63 is arranged in the conveying path 72. The stirring screw 63 stirs the developer by rotating, and transports the developer in the direction indicated by the arrow DD1. Thereby, the toner in the developer is triboelectrically charged. An opening 66*a* is provided on partition wall 66 at the most downstream in the direction indicated by the arrow DD1. The developer D in the conveying path 72 is drawn up to the conveying path 71 through the opening 66*a*. The stirring screw 63 extends in the right direction in FIG. 3, being compared with the supply screw 62, and the portion of the stirring screw 63 extending in the right direction in FIG. 3 faces the supply port 64*a*.

The supply screw 62 is disposed in the conveying path 71. As the supply screw 62 rotates, it conveys the developer supplied from the stirring screw 63 through the opening 66*a* in the direction indicated by the arrow DD2. The supply screw 62 and the stirring screw 63 are basically rotated at the same speed. When being conveyed by the supply screw 62, the developer is supplied to the developing sleeve 61. An opening 66*b* is provided in the partition wall on the most downstream side in the direction indicated by the arrow DD2. The developer remaining without being supplied to the developing sleeve 61 is drawn down from the conveying path 71 to the conveying path 72 through the opening 66*b*.

The developing sleeve 61 is disposed at a certain distance from the photoreceptor drum 81. The developing sleeve 61 develops the electrostatic latent image formed on the surface of the photoreceptor drum 81, by using the developer. The developing sleeve 61 is rotationally driven and is opposed to the photoreceptor drum 81 with a predetermined space therebetween. The developing sleeve 61 includes a magnet member (not shown) on the inner peripheral side thereof. This magnet member is magnetized alternately to N pole and S pole along the circumferential direction. The developing sleeve 61 captures and holds the developer conveyed by the supply screw 62 on the outer peripheral surface of the developing sleeve 61, by the magnetic force of the magnet member.

The developing sleeve 61 supplies the toner contained in the developer held on the outer peripheral surface to the surface of the photoreceptor drum 81. The toner is supplied to the surface of the photoreceptor drum 81 by the potential difference between the developing bias and the surface potential of the photoreceptor drum 81. As a result, the electrostatic latent image formed on the surface of the photoreceptor drum 81 is developed with toner, and the toner image is formed on the surface of the photoreceptor drum 81.

The supply screw 62 and the stirring screw 63 play a role of supplying the developer to the developing sleeve 61. Further, the supply screw 62 and the stirring screw 63 play a role of recovering the ratio between the toner and the carrier in the developer, by stirring the developer having a low ratio of the toner and the carrier returned from the developing sleeve 61.

The toner concentration sensor 65 is disposed on the outer peripheral surface of the casing 64 in the vicinity of the conveying path 72. The toner concentration sensor 65 outputs a value indicative of the toner concentration (ratio of toner to carrier in this case) of the developer (developer stirred by the stirring screw 63) accommodated in the casing 64.

Figure 4:
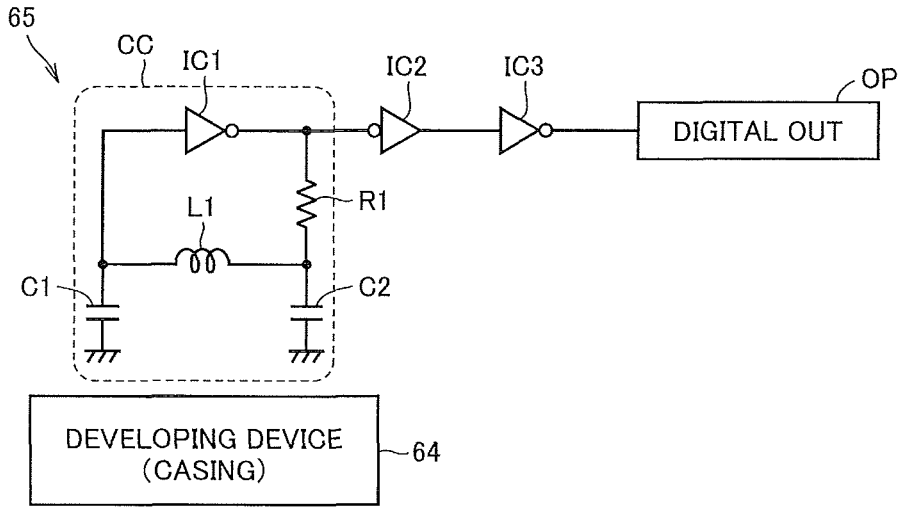
FIG. 4 is a diagram showing a circuit configuration of the toner concentration sensor 65 according to the first embodiment of the present invention.

FIG. 4 is a diagram showing a circuit configuration of the toner concentration sensor 65, according to the first embodiment of the present invention.

Referring to FIG. 4, the toner concentration sensor 65 includes a coil L1, inverters IC1, IC2 and IC3, capacitors C1 and C2, a resistor R1, and a digital output unit OP.

The toner concentration sensor 65 outputs the change in the inductance of the coil L1 due to the change in the ratio between the toner and the carrier in the developer accommodated in the casing 64, as a change in the oscillating frequency. Here, a Colpitts oscillation circuit CC is used as an oscillating circuit. The Colpitts oscillation circuit CC is an LC tuned oscillation circuit, and is composed of one coil L1, two capacitors C1 and C2, a resistor R1, and an inverter IC1. When the combined capacitance of the two capacitors C1 and C2 is the capacitance C, and the inductance of the coil L1 is L1, the oscillation frequency f of the Colpitts oscillation circuit CC is expressed by the following expression (1).

$$f=1/(2*pi*\text{Square Root}(L*C)) \quad (1)$$

Figure 5:
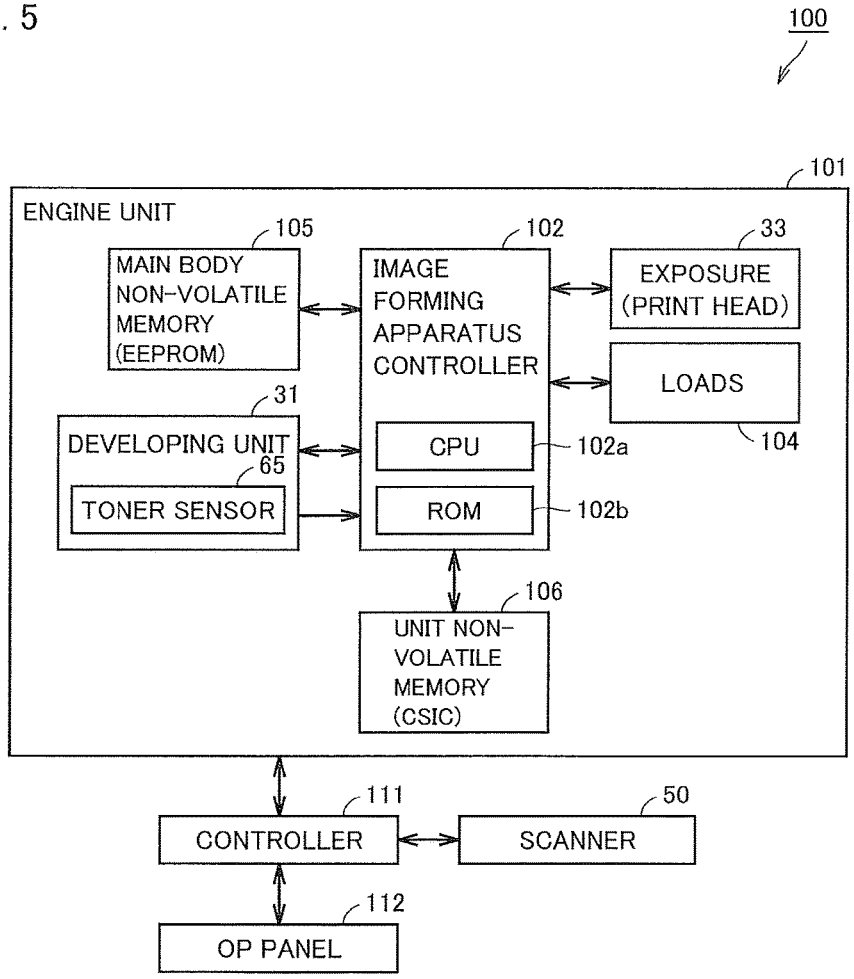
FIG. 5 is a block diagram showing a control configuration of the image forming apparatus 100 according to the first embodiment of the present invention.

FIG. 5 is a block diagram showing a control configuration of the image forming apparatus 100, according to the first embodiment of the present invention.

Referring to FIG. 5, image forming apparatus 100 further includes engine unit 101, controller unit 111, and operation panel 112. The controller unit 111 is connected to each of the engine unit 101, the operation panel 112, and the scanner unit 50.

The controller unit 111 controls the entire image forming apparatus 100, and includes a CPU (Central Processing Unit), a ROM (Read Only Memory), a RAM (Random Access Memory), and the like. The controller unit 111 acquires data of an image to be printed, from a PC (Personal Computer) (not shown) or the scanner unit 50, determines image data to be output, and instructs the image to be output to the engine unit 101.

The operation panel 112 displays various kinds of information and accepts various operations.

The engine unit 101 is a unit that performs a printing operation. The engine unit 101 includes an image forming apparatus control unit 102 and various loads 104. The engine unit 101 includes a main body attached nonvolatile memory 105, a unit attached nonvolatile memory 106, the developing unit 31, the exposure device (print head) 33, and the like.

The image forming apparatus control unit 102 includes a CPU 102*a* and a ROM 102*b*. In accordance with the control program, the CPU 102*a* controls the entire engine unit 101 including the developing unit 31, the exposure device 33, and various loads 104. The CPU 102*a* is connected to each of the developing unit 31, the exposing device 33, the various loads 104, the main body attached nonvolatile memory 105, and the unit attached nonvolatile memory 106. The ROM 102*b* stores a control program executed by the CPU 102*a*.

The various loads 104 are loads for performing a printing operation, such as motors for conveying paper, supplying toner, creating an image, and a fixing heater, and so on.

The main body attached nonvolatile memory 105 is a recording medium comprising of, for example, EEPROM (Electrically Erasable Programmable Read-Only Memory). The main body attached nonvolatile memory 105 stores data measured by the CPU 102*a* and the like.

The unit attached nonvolatile memory 106 is a recording medium called CSIC (Customer Specific Integrated Circuit). The unit attached nonvolatile memory 106 is attached to a consumable item, and stores information of such as the consumable item.

Further, the CPU 102*a* exchanges necessary information such as dot counts and image data, with the controller unit 111.

Further, the CPU 102*a* is connected to the toner concentration sensor 65 mounted on the developing unit 31. The CPU 102*a* obtains output values indicative of the toner concentration of the developer accommodated in the casing 64, from the toner concentration sensor 65. The CPU 102*a* performs the automatic TCR adjustment by performing the operation to be described later, when the newly unused developing device is attached to the image forming apparatus 100.

Next, the problems of the conventional automatic TCR adjustment method will be described.

Figure 6:
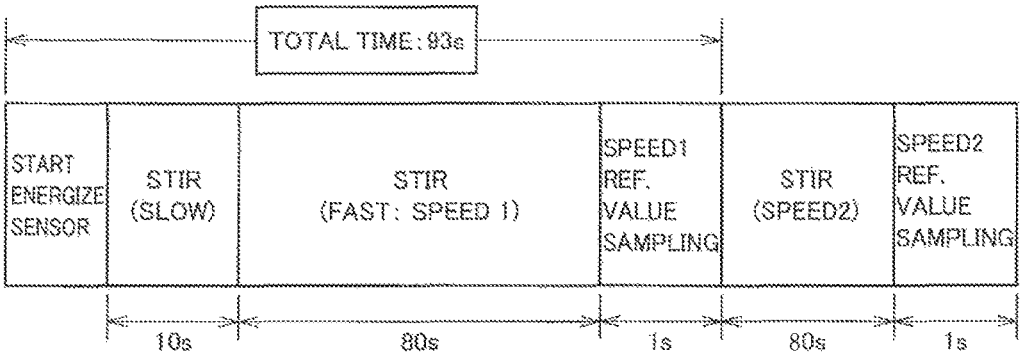
FIG. 6 is a diagram illustrating an example of the automatic TCR adjustment method performed by a conventional image forming apparatus.

FIG. 6 is a diagram illustrating an example of the automatic TCR adjustment method, performed by a conventional image forming apparatus.

Referring to FIG. 6, the conventional image forming apparatus performs automatic TCR adjustment by the following method. When the developing unit is left for a long period of time, the developer in the developing unit is hardened, and the torque at the start of rotation (start-up) of the supply screw and the stirring screw may become large. Therefore, the image forming apparatus performs the following operation in order to reduce the torque of the supply screw and the stirring screw. The image forming apparatus stirs the developer in the casing (preliminary stirring) for 10 seconds in a state in which the stirring speed (the rotation speed of the supply screw and the stirring screw) is lowered, after energization of the toner concentration sensor is started.

Next, the image forming apparatus stirs the developer in the casing for 80 seconds, in a state where the stirring speed is set to high speed (speed 1) in order to increase the charge amount of the toner and make the toner concentration of the developer uniform. The speed 1 is the stirring speed for any process speed. Subsequently, the image forming apparatus further stirs for 1 second, while maintaining the stirring speed at high speed (speed 1), and acquires the output value of the toner concentration sensor during that time. The image forming apparatus sets the acquired output value to the reference value of the toner concentration at the process speed corresponding to the set stirring speed.

In the case where the image forming apparatus operates at a plurality of process speeds, the image forming apparatus next performs stirring the developer in the casing for 80 seconds, with the speed 2 which is the stirring speed for another process speed. Subsequently, the image forming apparatus further stirs for 1 second while maintaining the stirring speed at high speed (speed 2), and acquires the output value of the toner concentration sensor during that time. The image forming apparatus sets the acquired output value to the reference value of the toner concentration at the process speed corresponding to the set stirring speed.

When the image forming apparatus operates at another process speed, the image forming apparatus acquires the output value of the toner concentration at the stirring speed at each process speed. The image forming apparatus sets the acquired output value to the reference value of the toner concentration at the process speed.

Figure 7:
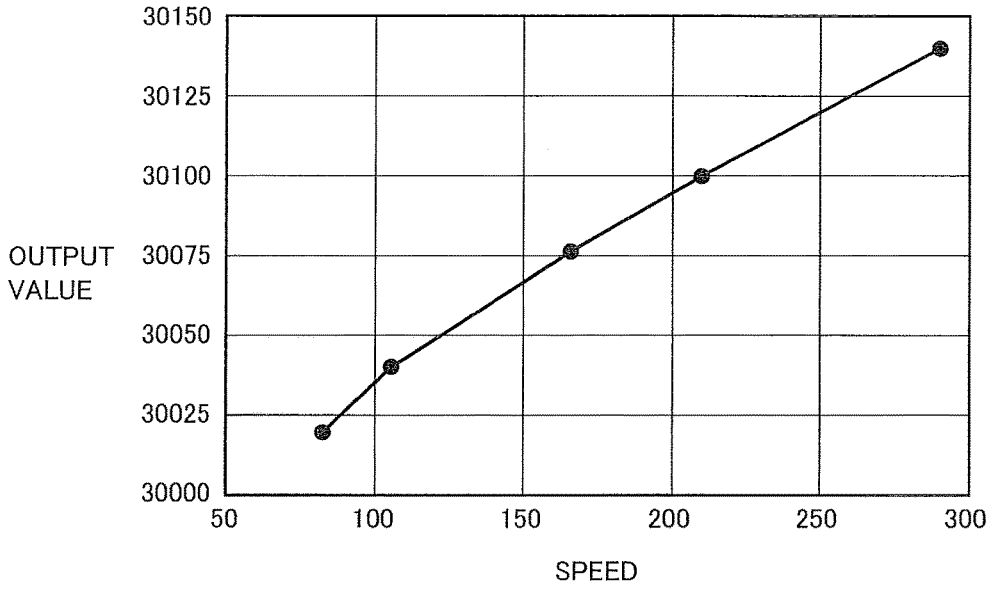
FIG. 7 is a diagram schematically showing a relationship between output values of the toner concentration sensor and process speeds.

FIG. 7 is a diagram schematically showing a relationship between output values of the toner concentration sensor and process speeds.

Referring to FIG. 7, the faster the stirring speed, the less the space is formed between the particles constituting the developer to be stirred, and the magnetic permeability of the developer tends to be higher. Therefore, the flowability of the developer becomes better as the stirring speed increases, and the output value of the toner concentration sensor becomes higher. Therefore, as described in FIG. 6, when the image forming apparatus operates at a plurality of process speeds, the image forming apparatus has reference values of the toner concentration for process speeds (for stirring speeds).

Figure 8:
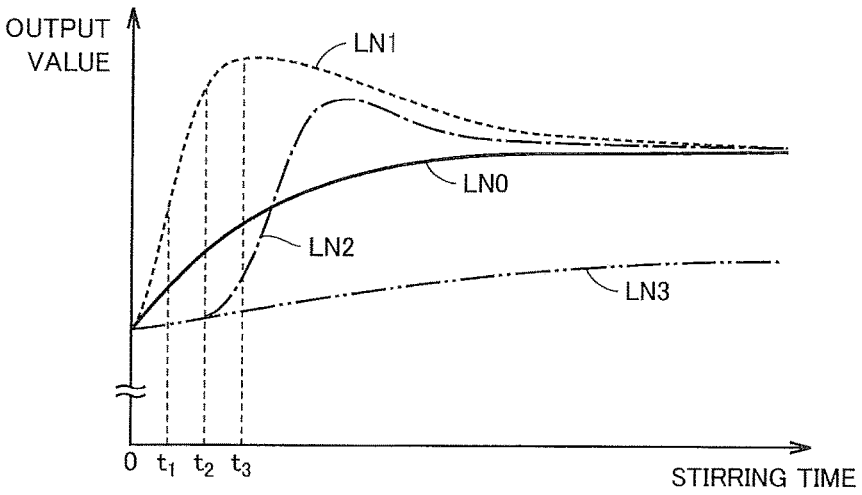
FIG. 8 is a view showing an example of a behavior of an output value of the toner concentration sensor, with respect to a stirring time of the developer in a new and unused developing unit.
Figure 9:
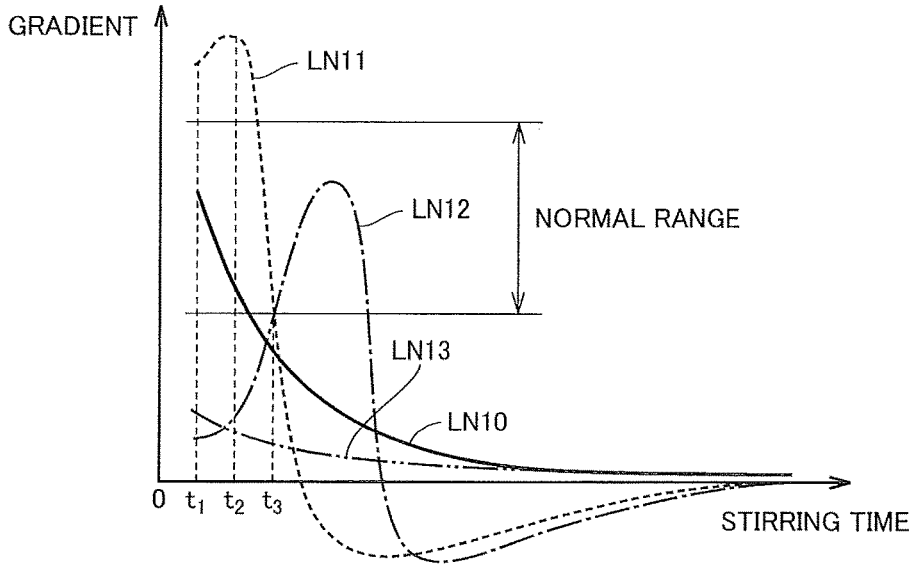
FIG. 9 is a view showing an example of a behavior of a change amount per unit time of an output value of the toner concentration sensor, with respect to a stirring time of the developer in a new and unused developing unit.

FIG. 8 is a view showing an example of the behavior of the output value of the toner concentration sensor, with respect to the stirring time of the developer in the newly unused developing unit. FIG. 9 is a view showing an example of the behavior of the amount of change per unit time (hereinafter sometimes referred to as the gradient of the output value) of the output value of the toner concentration sensor, with respect to the stirring time of the developer in the newly unused developing unit. In FIGS. 8 and 9, the behavior of the portion of preliminary stirring for 10 seconds in FIG. 6 is omitted.

With reference to FIGS. 8 and 9, when the new and unused developing unit was appropriately stored before being mounted on the image forming apparatus, the developer is relatively uniformly present in the developing unit (Hereinafter, such a developing unit may be referred to as a normal developing unit in some cases). According to a normal developing unit, the output value of the toner concentration sensor gradually increases as the stirring time increases, as indicated by a line LN0 in FIG. 8, and converges to a constant value. As a result, the gradient of the output value of the toner concentration sensor gradually decreases with the increase of the stirring time as indicated by a line LN10 in FIG. 9, and converges to a constant value (zero).

On the other hand, if the new and unused developing unit was improperly stored before being mounted on the image forming apparatus, the developer in the developing unit is not in a normal state as follows.

Figure 10:
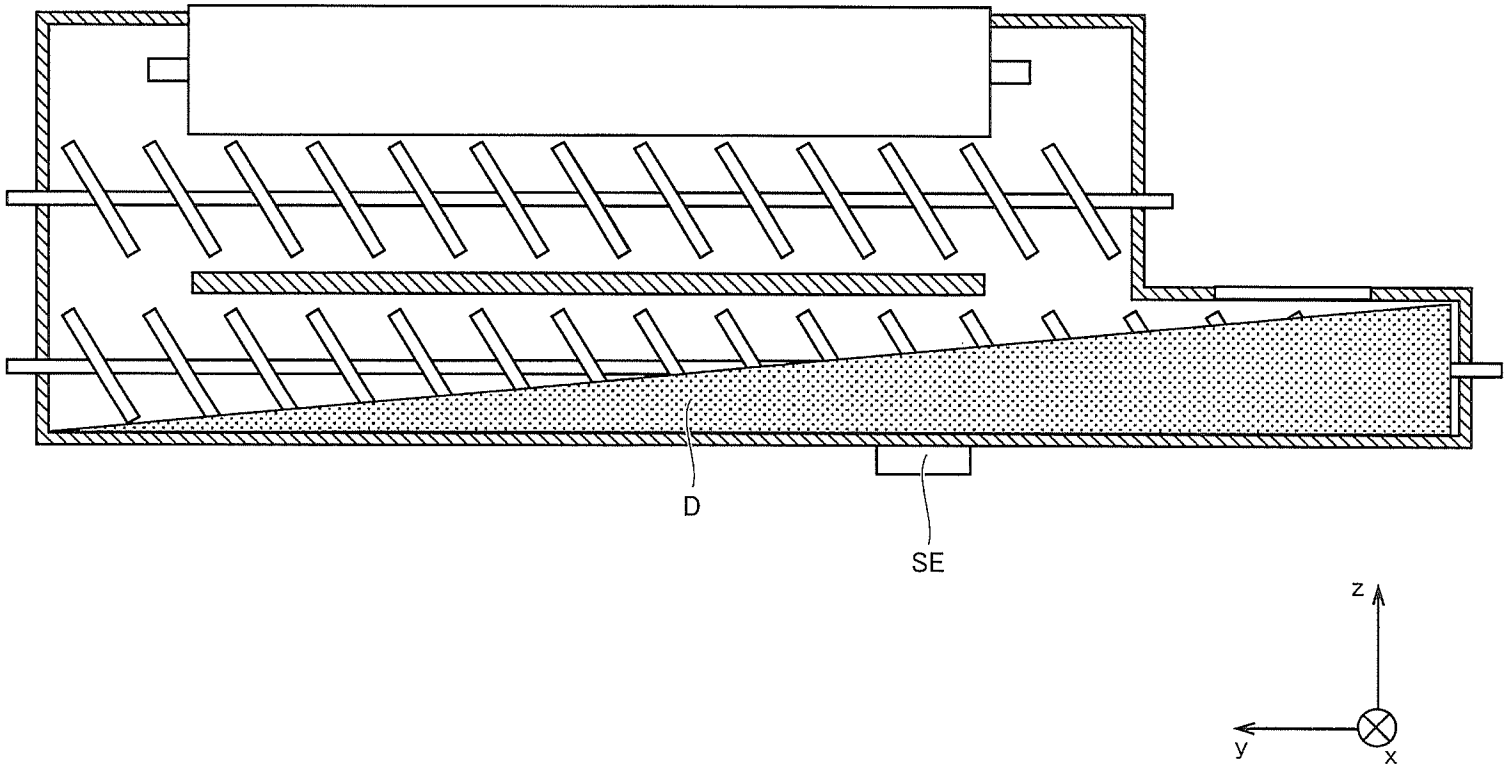
FIG. 10 is a diagram schematically showing a state in which the developer D is unevenly distributed on the toner concentration sensor SE side in the developing unit.
Figure 11:
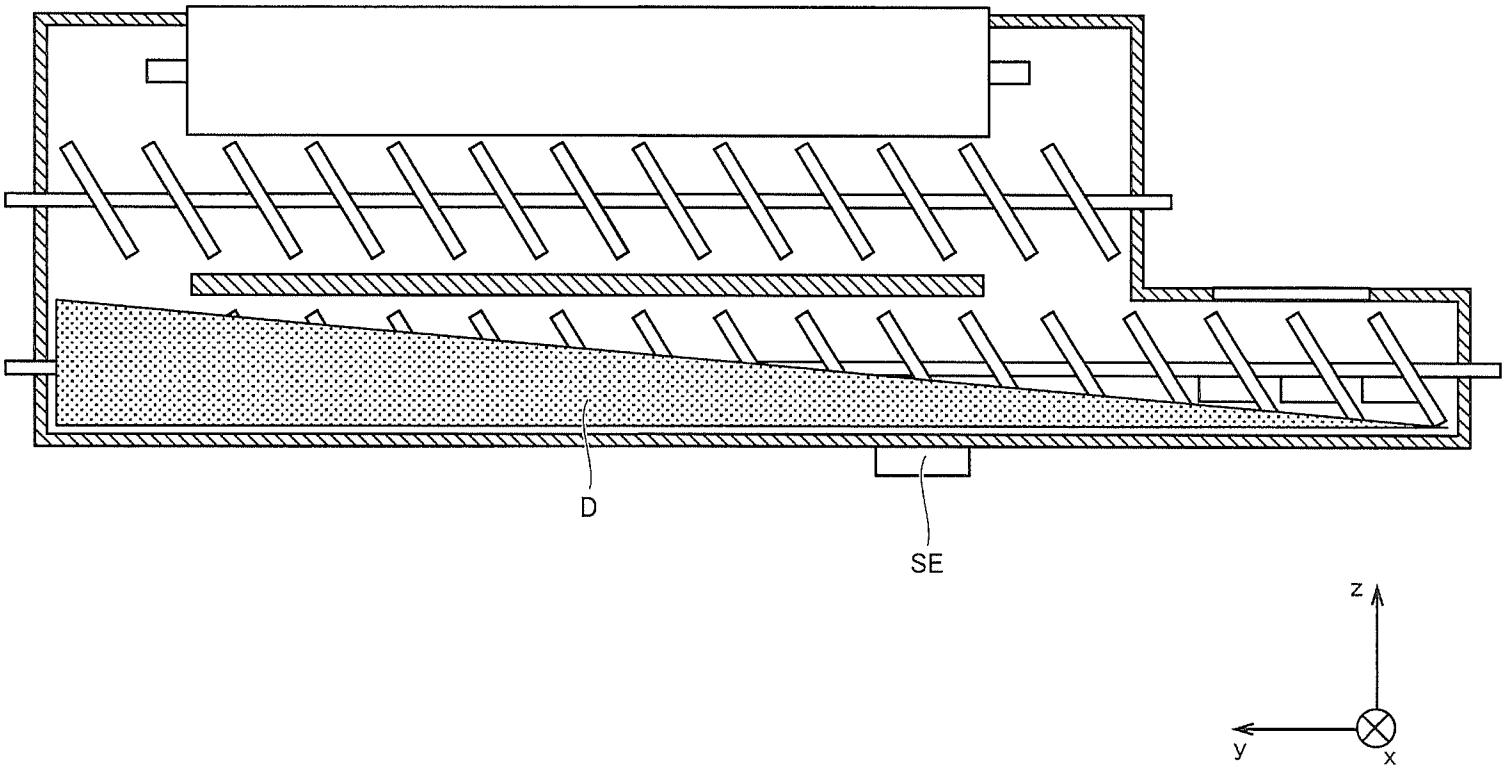
FIG. 11 is a diagram schematically showing a state in which the developer D is unevenly distributed on the side opposite to the toner concentration sensor SE in the developing unit.

FIG. 10 is a diagram schematically showing a state in which the developer D is unevenly distributed on the toner concentration sensor SE side in the developing unit. FIG. 11 is a diagram schematically showing a state in which the developer D is unevenly distributed on the side opposite to the toner concentration sensor SE in the developing unit.

With reference to FIGS. 8 to 11, as shown in FIG. 10, the developer D is unevenly distributed on the toner concentration sensor SE side (the right side in FIG. 10). In this case, as shown by the line LN1 in FIG. 8, the output value of the toner concentration sensor becomes high due to the excessive amount of developer near the toner concentration sensor SE, at the beginning of stirring. After that, when the developer is homogenized by stirring, the output value of the toner concentration sensor converges to a constant value. As a result, the gradient of the output value of the toner concentration sensor increases sharply at the beginning of stirring as indicated by a line LN11 in FIG. 9, then becomes minus and finally converges to a constant value (zero).

As shown in FIG. 11, the developer D is unevenly distributed on the opposite to the toner concentration sensor SE side (the left side in FIG. 11). In this case, as shown by a line LN2 in FIG. 8, the output value of the toner concentration sensor is low due to the deficiency of the developer in the vicinity of the toner concentration sensor SE in the initial stage of stirring. Subsequently, since a large amount of the developer reaches the vicinity of the toner concentration sensor SE by stirring, the output value of the toner concentration sensor sharply increases. After that, when the developer is homogenized by stirring, the output value of the toner concentration sensor converges to a constant value. As a result, the gradient of the output value of the toner concentration sensor increases at the beginning of the stirring as shown by a line LN12 in FIG. 9, then becomes a minus, finally converging to a constant value (zero). (Hereinafter, the developing unit in which the developer is unevenly distributed as shown in FIGS. 10 and 11 may be referred to as a biased developing unit).

As still another example, when the developing unit is left for a long time, when subjected to vibration during transportation, or when it is stored in a high humidity environment, the charge amount of the toner decreases. In this case, the developer is in a solidified state (tightened state). (Hereinafter, such a developing unit may be referred to as remaining developing unit in some cases). According to a remaining developing unit, since the developer does not flow even with stirring, the output value of the toner concentration sensor hardly changes as indicated by line LN3 in FIG. 8 and line LN13 in FIG. 9. The reference value of the toner concentration set in this case becomes an abnormally low value, and the image forming apparatus performs control to keep the toner concentration of the developer in the developing unit at a low value.

The image forming apparatus 100 according to the present embodiment determines whether or not the developer in the casing 64 has become uniform, by the following method, in consideration of the state difference of the developer in the developing unit.

The CPU 102*a* of the image forming apparatus 100 starts stirring (preliminary stirring) of the developer in the casing 64, by the supply screw 62 and the stirring screw 63, at the time of automatic TCR adjustment. After that, the CPU 102*a* acquires the output value a of the toner concentration sensor 65. Then, The CPU 102*a* calculates the gradient b of the acquired output value, and determines whether or not the developer in the casing 64 has become uniform based on the calculated gradient b of the output value.

Figure 12:
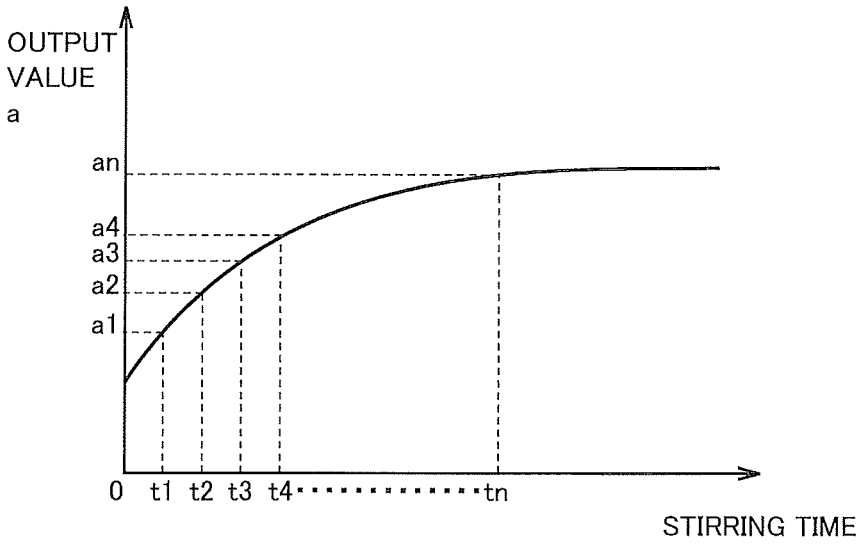
FIG. 12 is a first diagram showing a method of automatic TCR adjustment performed by the image forming apparatus 100 in the first embodiment of the present invention.
Figure 13:
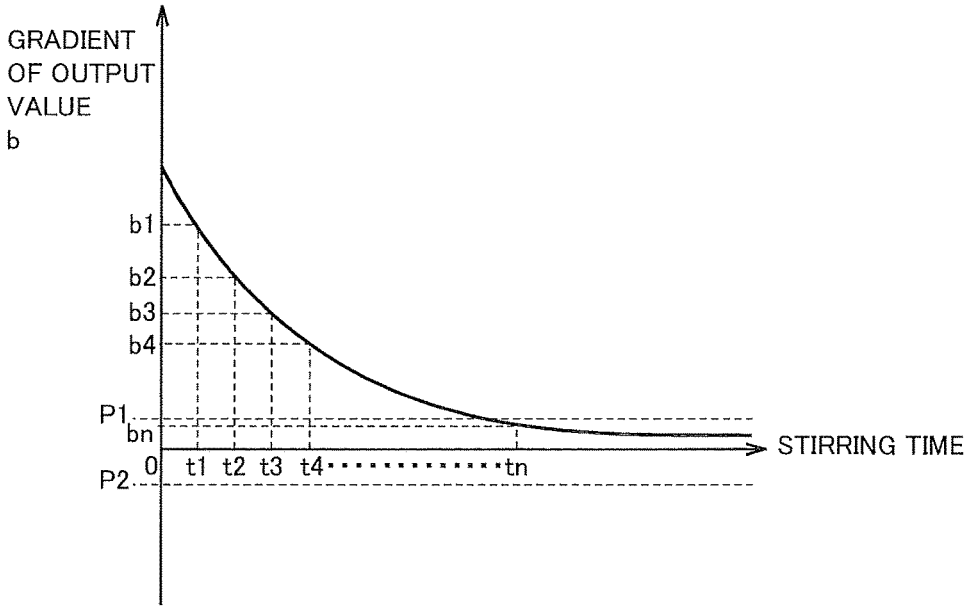
FIG. 13 is a second diagram showing a method of automatic TCR adjustment performed by the image forming apparatus 100 in the first embodiment of the present invention.

FIGS. 12 and 13 are diagrams showing a method of automatic TCR adjustment performed by the image forming apparatus 100 in the first embodiment of the present invention. FIG. 12 is a diagram showing the behavior of the output value of the toner concentration sensor, with respect to the stirring time of the developer in the new and unused developing unit 31. FIG. 13 is a diagram showing the behavior of the gradient of the output value of the toner concentration sensor, with respect to the stirring time of the developer in the new and unused developing unit 31.

With reference to FIGS. 12 and 13, the CPU 102*a* acquires the following values, after starting the preliminary stirring of the developer in the casing 64. The CPU 102*a* repeatedly obtains the output values a1, a2, a3, a4 . . . an of the toner concentration sensor 65 at times t1, t2, t3, t4 . . . tn, at necessary time intervals. Every time the output value of the toner concentration sensor 65 is acquired, the CPU 102*a* calculates the gradient b (specifically, the gradients b1, b2, b3, b4, bn) of the output value of the toner concentration sensor 65. The CPU 102*a* determines whether or not the calculated gradient b is within a predetermined range (P1<b<P2) (an example of the first range). (This predetermined range is a range including zero). The CPU 102*a* determines that the gradient bn calculated from the output value an at time tn is within a predetermined range (P1<bn<P2), and determines that the developer in the casing 64 has become uniform.

Note that the gradient b used in the judging process in this specification may be calculated from one output value a. However, in order to improve the accuracy of determination, the gradient b is preferably calculated from a plurality of output values a's.

The CPU 102*a* terminates the preliminary stirring at time tn, when it is determined that the developer in the casing 64 has become uniform. The CPU 102*a* starts stirring at the stirring speed corresponding to the process speed of the image forming apparatus 100. The CPU 102*a* sets the output value acquired after the time tn (or the output value an acquired at the time tn) as the reference value of the toner concentration. The reference value of the toner concentration is a reference value of the toner concentration of the developer in the casing 64 and is a reference value for judging whether to replenish the toner to the developing unit 31.

When the image forming apparatus 100 has process speeds, the image forming apparatus 100 acquires the output value of the toner concentration sensor 65 while sequentially stirring at the stirring speeds corresponding to the process speeds. The image forming apparatus 100 sets the obtained output values as reference values of the toner concentration at the process speeds.

Figure 14:
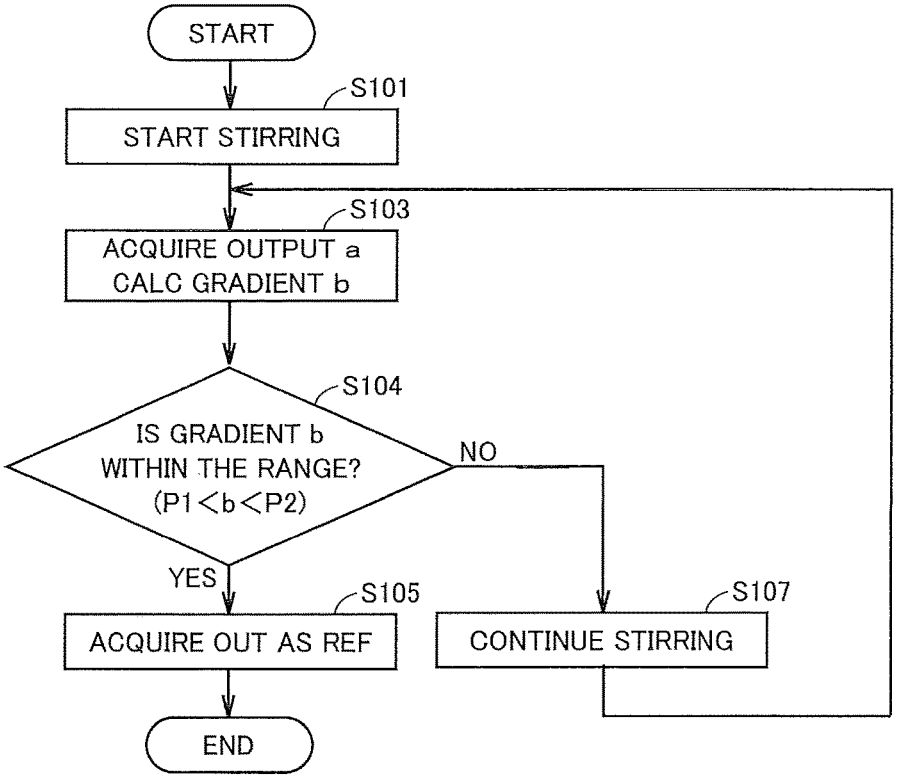
FIG. 14 is a flowchart showing the operation of the image forming apparatus 100, when automatic TCR adjustment is performed in the first embodiment of the present invention.

FIG. 14 is a flowchart showing the operation of the image forming apparatus 100, when automatic TCR adjustment is performed in the first embodiment of the present invention.

With reference to FIG. 14, this flowchart is realized by the CPU 102*a* operating according to the control program stored in the ROM 102*b*. The CPU 102*a* starts preliminary stirring of the developer in the casing 64, by the supply screw 62 and the stirring screw 63 (S101), obtains the output value a of the toner concentration sensor 65, and calculates the gradient b of the acquired output value (S103). Next, the CPU 102*a* determines whether or not the calculated gradient b is within a predetermined range (P1<b<P2) (S104).

If it is determined in step S104 that the calculated gradient b is not within the predetermined range (NO in S104), the CPU 102*a* continues the preliminary stirring and to acquire the output value a (S107), and the process proceeds to step S103.

In step S104, when determining that the calculated gradient b is within the predetermined range (YES in S104), the CPU 102*a* determines that the developer in the casing 64 has become uniform. In this case, the CPU 102*a* terminates the preliminary stirring and starts stirring at the stirring speed corresponding to the process speed of the image forming apparatus 100. The CPU 102*a* acquires the output value of the toner concentration sensor 65, which is the reference value of the toner concentration (S105), and ends the process.

According to the present embodiment, it is judged whether or not the toner concentration in the developing unit 31 is uniform based on the gradient of the output value of the toner concentration sensor 65, even when the state of the developer in the developing unit varies among individuals. After judging that the toner concentration is uniform, the reference value of the toner concentration is set. Thus, it is possible to properly set the reference value of the toner concentration. In addition, since the preliminary stirring is performed for a time corresponding to the state of the developer in the developing unit, it is possible to appropriately set the time of the preliminary stirring and the timing of acquiring the reference value of the toner concentration, and it is possible to shorten the time required for the automatic adjustment of the TCR.

The present embodiment is preferably applied to a case where the developer in the developing unit 31 is in a relatively uniform state, that is, a case where the reference value of the toner concentration is set in the factory at the time of production of the image forming apparatus 100.

Second Embodiment

The image forming apparatus 100 in this embodiment starts preliminary stirring of the developer in the casing 64, by the supply screw 62 and the stirring screw 63 at the time of automatic TCR adjustment. Thereafter, the image forming apparatus 100 repeatedly obtains the output value a of the toner concentration sensor 65 at necessary time intervals. The image forming apparatus 100 calculates the gradient b of each acquired output value. Based on the gradient b of the calculated output value, the image forming apparatus 100 predicts the necessary stirring time until the developer in the casing 64 becomes uniform (until the output value of the toner concentration sensor 65 is stabilized). After the predicted stirring time has elapsed, the image forming apparatus 100 determines that the developer in the casing 64 has become uniform, and acquires the reference value of the toner concentration from the toner concentration sensor 65.

Figure 15:
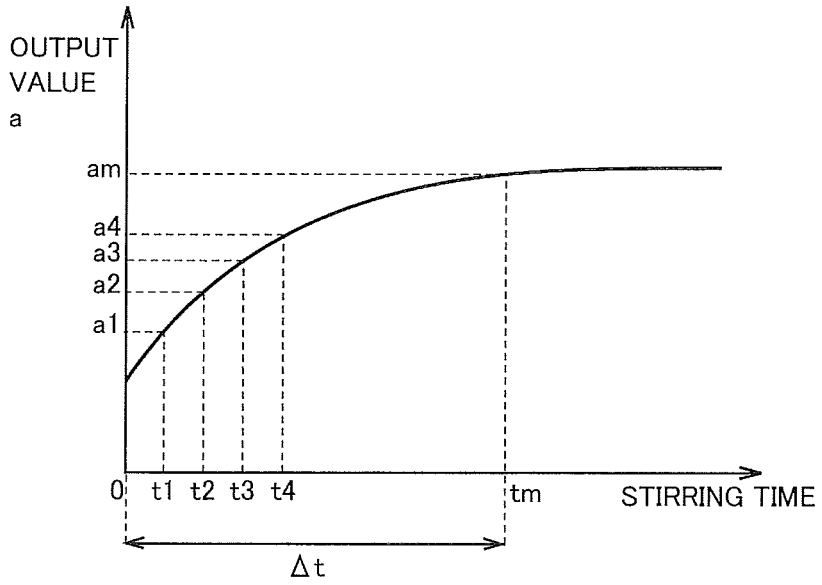
FIG. 15 is a first diagram showing a method of automatic TCR adjustment performed by the image forming apparatus 100, according to the second embodiment of the present invention.
Figure 16:
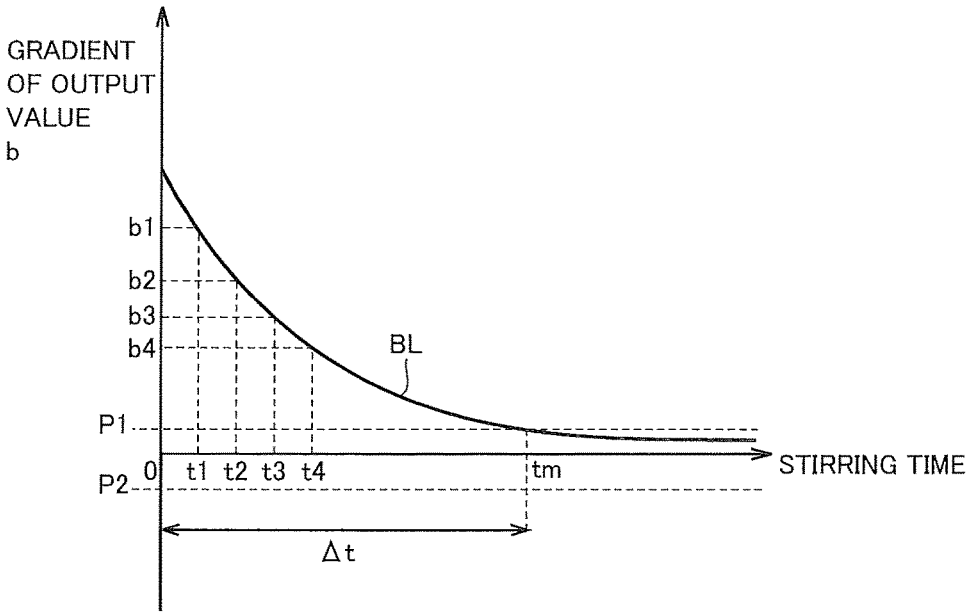
FIG. 16 is a second diagram showing a method of automatic TCR adjustment performed by the image forming apparatus 100 in the second embodiment of the present invention.

FIGS. 15 and 16 are diagrams showing a method of automatic TCR adjustment performed by the image forming apparatus 100 in the second embodiment of the present invention. FIG. 15 is a diagram showing the behavior of the output value of the toner concentration sensor with respect to the stirring time of the developer in the new and unused developing unit 31. FIG. 16 is a diagram showing the behavior of the gradient of the output value of the toner concentration sensor with respect to the stirring time of the developer of the new and unused developing unit 31.

With reference to FIGS. 15 and 16, the CPU 102*a* starts preliminary stirring of the developer in the casing 64. Thereafter, the CPU 102*a* repeatedly acquires the output values a1, a2, a3, and a4 of the toner concentration sensor 65 at the times t1, t2, t3, and t4 at the necessary time intervals. The number of repeatedly acquired output values is arbitrary. Every time the output value of the toner concentration sensor 65 is acquired, the CPU 102*a* calculates the gradient b (specifically, the gradients b1, b2, b3, and b4) of the output value of the toner concentration sensor 65. As the gradient b of the calculated output value gradually decreases with the elapse of stirring time as shown in FIG. 16, the curve BL connecting the gradients can be calculated as an approximate expression. Based on the approximate expression of the curve BL, the CPU 102*a* predicts the necessary stirring time DELTA t until the gradient b falls within a predetermined range (P1<b<P2).

The CPU 102*a* continues the preliminary stirring until the stirring time DELTA t has elapsed. The CPU 102*a* determines that the developer in the casing 64 has become uniform at the time tm, after the stirring time DELTA t has elapsed. The CPU 102*a* terminates the preliminary stirring at time tm and starts stirring at the stirring speed corresponding to the process speed of the image forming apparatus 100.

Then, The CPU 102*a* sets the output value am that is the output value acquired after the time tm (or the output value acquired at the time tm) as the reference value of the toner concentration.

Figure 17:
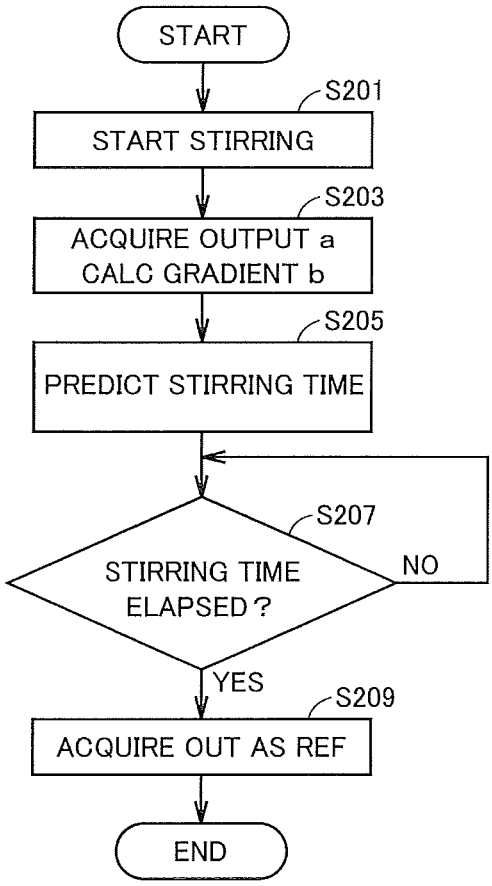
FIG. 17 is a flowchart showing the operation of the image forming apparatus 100, when automatic TCR adjustment is performed in the second embodiment of the present invention.

FIG. 17 is a flowchart showing the operation of the image forming apparatus 100 when automatic TCR adjustment is performed in the second embodiment of the present invention.

With reference to FIG. 17, this flowchart is realized by the CPU 102*a* operating according to the control program stored in the ROM 102*b*. The CPU 102*a* starts preliminary stirring of the developer in the casing 64 by the supply screw 62 and the stirring screw 63 (S201), obtains the output value a of the toner concentration sensor 65, and calculates the gradient b of the acquired output value (S203). Next, the CPU 102*a* predicts the stirring time necessary to make the developer in the casing 64 become uniform (S205), based on the obtained gradient b's of the output value. Subsequently, the CPU 102*a* determines whether or not the predicted stirring time has elapsed (S207). The CPU 102*a* repeats the process of step S207 until it is determined that the predicted stirring time has elapsed.

If it is determined in step S207 that the predicted stirring time has elapsed (YES in step S207), the CPU 102*a* determines that the developer in the casing 64 has become uniform. In this case, the CPU 102 a terminates the preliminary stirring and starts stirring at the stirring speed corresponding to the process speed of the image forming apparatus 100. The CPU 102*a* acquires the output value of the toner concentration sensor 65, which is the reference value of the toner concentration (S209), and ends the process.

The configuration of the image forming apparatus according to the present embodiment and the operations other than those described above are the same as those of the image forming apparatus according to the first embodiment, so the description thereof will not be repeated.

According to the present embodiment, the stirring time required until the developer in the casing becomes uniform is predicted, based on the gradient of the output value of the toner concentration sensor at the start of stirring (based on the cumulative gradients of the output value of the toner concentration sensor from the initial stage of stirring). As a result, regardless of the change in the state of the developer in the developing unit after the prediction, an output value that becomes the reference value of the toner concentration is acquired after stirring for an appropriate time. Therefore, it is possible to appropriately measure the reference value of the toner concentration, and to improve the reliability of the reference value of the toner concentration.

Third Embodiment

In the present embodiment, the image forming apparatus 100 determines the new and unused developing unit attached to the image forming apparatus 100 is which of a normal developing unit, a biased developing unit, and a remaining developing unit. A case where the image forming apparatus 100 performs an operation based on the determination result will be described.

Figure 18:
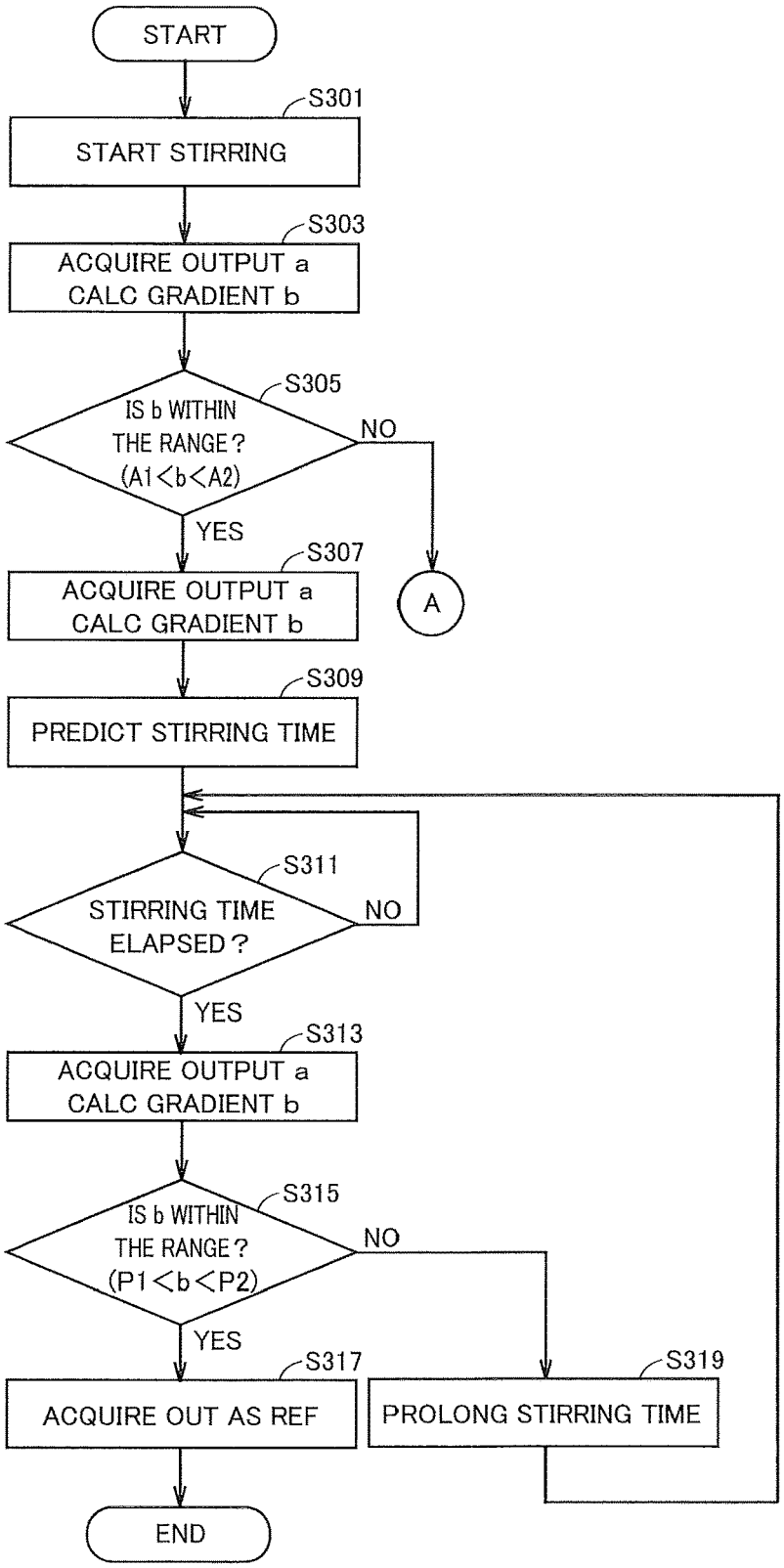
FIG. 18 is a first part of a flowchart showing the operation of the image forming apparatus 100, when automatic TCR adjustment is performed in the third embodiment of the present invention.
Figure 19:
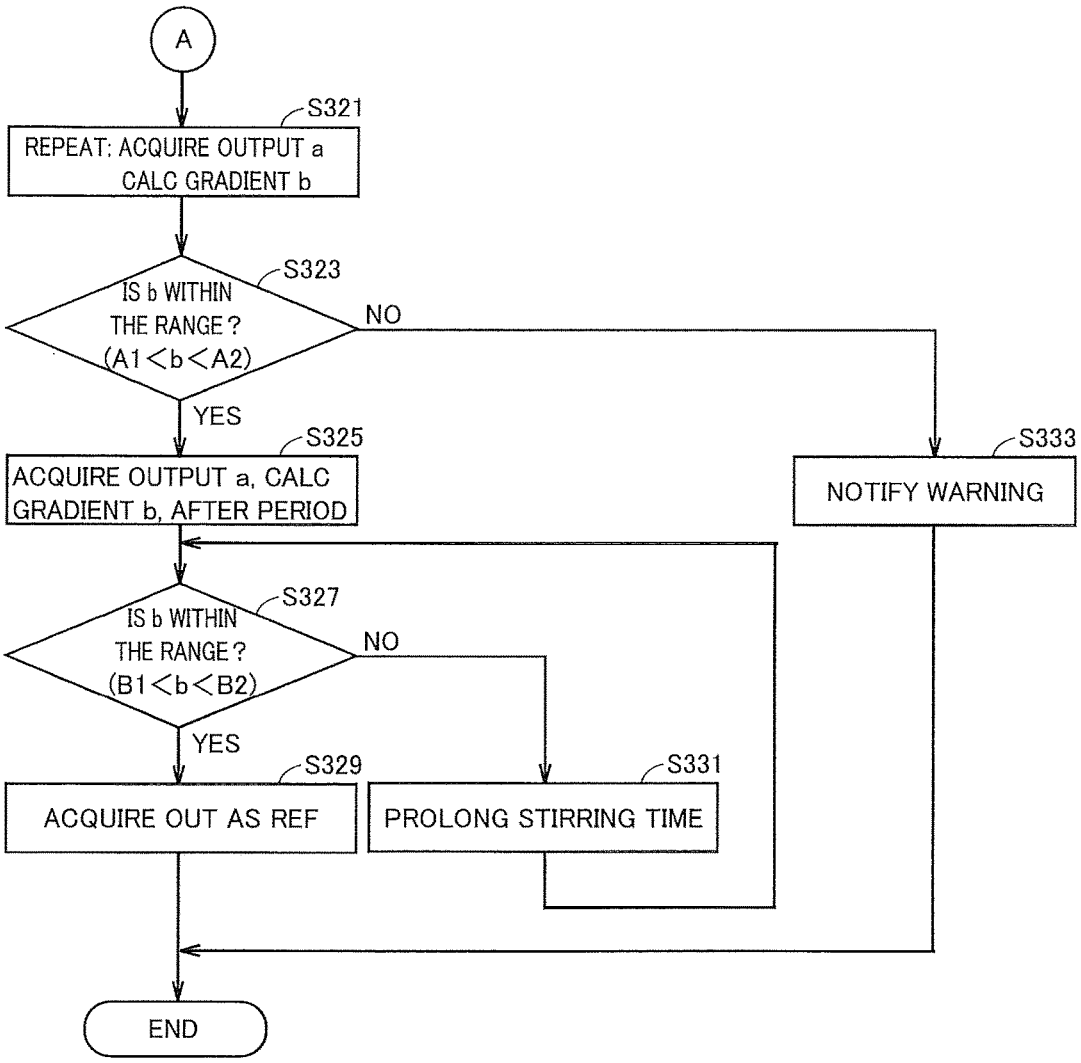
FIG. 19 is a second part of the flowchart showing the operation of the image forming apparatus 100, when automatic TCR adjustment is performed in the third embodiment of the present invention.

FIGS. 18 and 19 shows flowcharts of the operation of the image forming apparatus 100, when automatic TCR adjustment is performed in the third embodiment of the present invention.

With reference to FIG. 18, this flowchart is realized by the CPU 102*a* operating according to the control program stored in the ROM 102*b*. The CPU 102*a* starts preliminary stirring of the developer in the casing 64, by the supply screw 62 and the stirring screw 63 (S301). Next, the CPU 102*a* repeatedly acquires the output value a of the toner concentration sensor 65 immediately after the start of stirring, at necessary time intervals, and calculates the gradient b of the acquired output value (S303). Subsequently, the CPU 102*a* determines whether or not the calculated gradient b (gradient b at the initial stage of stirring) is within a predetermined range (A1<b<A2) (an example of the second range) (S305).

In step S305, when it is determined that the calculated gradient b is not within the predetermined range (NO in S305), the CPU 102*a* determines that the new unused developing unit attached to the image forming apparatus 100 is a biased developing unit or a remaining developing unit. In this case, the CPU 102*a* proceeds to the process of step S321 in FIG. 19.

In step S305, when it is determined that the calculated gradient b is within the predetermined range (YES in S305), the CPU 102*a* determines that the new and unused developing unit attached to the image forming apparatus 100 is a normal developing unit. In this case, the CPU 102*a* obtains the output value a of the toner concentration sensor 65 and calculates the gradient b of the acquired output value (S307). In step S307, instead of calculating the gradient b, the gradient b calculated in step S303 may be acquired.

Next, the CPU 102*a* predicts the necessary stirring time for making the developer in the casing 64 become uniform (S309), and determines whether or not the predicted stirring time has elapsed (S311). The CPU 102*a* repeats the process of step S311 until it is determined that the predicted stirring time has elapsed.

In step S311, when it is determined that the predicted stirring time has elapsed (YES in S311), the CPU 102*a* acquires the output value a of the toner concentration sensor 65 and calculates the gradient b of the acquired output value (S313). Subsequently, the CPU 102*a* determines whether or not the calculated gradient b is within a predetermined range (P1<b<P2) (an example of the first range) (S315).

In step S315, when it is determined that the calculated gradient b is not within the predetermined range (P1<b<P2) (NO in step S315), the CPU 102*a* prolongs the stirring time by a predetermined time TA (an example of the first time), and proceeds to the process of step S311. As a result, the CPU 102*a* again obtains the output value of the toner concentration sensor 65, and further determines whether or not the amount of change per unit time of the acquired output value is within a predetermined range (P1<b<P2).

Originally, if the predicted stirring time has elapsed, the developer in the developing unit 31 should be uniform. However, in the present embodiment, for confirmation, after the predicted stirring time has elapsed, it is determined whether or not the calculated gradient is within a predetermined range. In the unlikely event that the calculated gradient is not within the predetermined range, further stirring is performed. This makes it possible to more appropriately set the reference value of the toner concentration.

If it is determined in step S315 that the calculated gradient b is within the predetermined range (P1<b<P2) (YES in step S315), the CPU 102*a* determines that the developer in the casing 64 has become uniform. In this case, the CPU 102*a* terminates the preliminary stirring and starts stirring at the stirring speed corresponding to the process speed of the image forming apparatus 100. The CPU 102*a* acquires the output value of the toner concentration sensor 65, which is the reference value of the toner concentration (S317), and ends the process.

Referring to FIG. 19, in the case where the new and unused developing unit attached to image forming apparatus 100 is a biased developing unit or a remaining developing unit, it is difficult to express a curve showing the behavior of the output value of the toner concentration sensor, with respect to the stirring time by an approximate expression. Further, it is impossible to predict the necessary stirring time until the developer in the casing 64 becomes uniform. In this case, the CPU 102*a* performs the processing from step S321.

In step S321, the CPU 102*a* continues to acquire the output value a of the toner concentration sensor 65, at the necessary time intervals, as many times as necessary while continuing the stirring for a predetermined time TB (an example of the second time). The CPU 102*a* calculates the gradient b of the acquired output value (S321). When performing the process of step S321, since the prediction of the stirring time (S309 in FIG. 18) is not performed, the process of step S321 is started at a predetermined timing. Subsequently, the CPU 102*a* continues the stirring for a predetermined time TB, and determines whether or not the gradient b calculated during the predetermined time TB falls within a predetermined range (A1<b<A2) (S323).

If it is determined in step S323 that the calculated gradient b falls within a predetermined range (A1<b<A2) (YES in S323), the CPU 102*a* determines that the new unused developing unit attached to the image forming apparatus 100 is a biased developing unit. In this case, the CPU 102*a* obtains the output value a of the toner concentration sensor 65 after a lapse of the predetermined time TC and calculates the gradient b of the acquired output value (S325). Subsequently, the CPU 102*a* determines whether or not the calculated gradient b is within a predetermined range (B1<b<B2) (S327). It is preferable that the range (B1<b<B2) used in step S327 is the same as the range used in step S323 (A1<b<A2), or narrower than the range used in step S323 (A1<b<A2).

If it is determined in step S327 that the calculated gradient b is not within the predetermined range (B1<b<B2) (NO in S327), the CPU 102*a* extends the stirring time by a predetermined time TD (S331), and the process proceeds to the process of step S327.

If it is determined in step S327 that the calculated gradient b is within the predetermined range (B1<b<B2) (YES in S327), the CPU 102*a* determines that the developer in the casing 64 becomes uniform. In this case, the CPU 102*a* terminates the preliminary stirring and starts stirring at the stirring speed corresponding to the process speed of the image forming apparatus 100. The CPU 102*a* acquires the output value of the toner concentration sensor 65, which is the reference value of the toner concentration (S329), and ends the process.

If it is determined in step S323 that the calculated gradient b does not fall within the predetermined range (A1<b<A2) (NO in S323), the CPU 102*a* determines that the new and unused developing unit attached to the image forming apparatus 100 is a remaining developing unit. This is because when the remaining developer is stirred, the gradient of the output value of the toner concentration sensor 65 deviates downward greatly from the predetermined range (A1<b<A2). In this case, the CPU 102*a* notifies the user by displaying a warning on the operation panel 112 indicating the remaining (abnormality) of the developing unit 31 (S333), and ends the process.

The configuration of the image forming apparatus according to the present embodiment and the operations other than those described above are the same as those of the image forming apparatus according to the first embodiment, so the description thereof will not be repeated.

According to the present embodiment, it is judged that a new unused developing unit mounted on the image forming apparatus 100 is which of a normal developing unit, a biased developing unit, and a remaining developing unit. Since the operation based on the judgment result is performed, it is possible to appropriately measure the reference value of the toner concentration.

[Others]

In the case where the image forming apparatus 100 acquires the output value a of the toner concentration sensor 65 in step S103 in FIG. 14, step S203 in FIG. 17, steps S303, S307 and S313 in FIG. 18, step S325 in FIG. 19, and so on, it is preferable that the image forming apparatus 100 acquires a plurality of output values a's at time intervals corresponding to the flow period of the developing device in the developing unit 31.

Referring to FIG. 3, the flow period of the developing device in the developing unit 31 is the period (required time) by which the developer circulates around the conveying path in the casing 64 of the developing unit 31 (the conveying path indicated by arrows DD1 and DD2 in FIG. 3).

In the case where the developer in the casing 64 is soft agglomerated and is accumulated in a part of the developer (there is a part that is solidified and unevenly distributed), a ripple occurs in the output value of the toner concentration sensor 65, each time the accumulated part of toner passes around the conveying path in the casing 64 of the developing unit 31 and passes through the measurement position by the toner concentration sensor 65. The generation cycle of the ripple is equal to the flow period of the developing device in the developing unit 31, and is determined by the process speed of the image forming apparatus 100. Therefore, the output value of the toner concentration sensor 65 is acquired at time intervals equal to the flow period of the developing device in the developing unit 31. Thus, it is possible to obtain output values from the same portion (a portion other than the accumulation portion which causes ripple) in the developer circulating around the conveying path each time. As a result, it is possible to predict the stirring time necessary to make the developer in the casing 64 become uniform, without being affected by the uneven distribution of the developer such as soft agglomeration of the developer.

The processes in the above-mentioned embodiments can be performed by software and a hardware circuit. A computer program which executes the processes in the above embodiments can be provided. The program may be provided recorded in recording media of CD-ROMs, flexible disks, hard disks, ROMs, RAMs, memory cards, or the like to users. The program is executed by a computer of a CPU or the like. The program may be downloaded to an apparatus via communication lines like the internet. The processes explained in the above flowcharts and the description are executed by a CPU in line with the program.

Effect of the Embodiment

According to the present embodiment, it is possible to provide an image forming apparatus and a control program for an image forming apparatus capable of appropriately measuring the reference value of toner concentration.

Although the present invention has been described and illustrated in detail, the disclosed embodiments are made for purposes of illustrated and example only and not limitation. The scope of the present invention being interpreted by terms of the appended claims.

What is claimed is:

1. An image forming apparatus comprising a developing device, wherein the developing device comprising:

a casing, two-component developer accommodated in the casing, and a screw that conveys the developer in the casing in a predetermined direction and rotation of the screw stirs the developer in the casing, wherein the image forming apparatus comprises:

a sensor that outputs a value indicative of toner concentration of the developer in the casing, and a hardware processor that judges whether or not the developer in the casing has become uniform, based on an amount of change per unit time of the output value of the sensor, acquired after start of stirring the developer in the casing by the screw.

2. The image forming apparatus according to claim 1, the hardware processor judges that the developer in the casing becomes uniform, when the amount of change per unit time of the output value of the sensor is within a first range, and the hardware processor obtains an output value which is a reference value of the toner concentration of the developer in the casing, and which is a reference value of the toner concentration for judging whether to replenish the toner to the developing device, from the sensor, when judging that the developer in the casing becomes uniform.

3. The image forming apparatus according to claim 2, wherein the hardware processor acquires repeatedly the output value of the sensor at necessary time intervals, after starting the stirring of the developer by the screw, predicts stirring time by the screw required until the developer in the casing becomes uniform, based on the acquired amount of change per unit time of the output value of the sensor, and determines that the developer in the casing has become uniform after the stirring time predicted has elapsed.

4. The image forming apparatus according to claim 3, wherein the hardware processor acquires the output value of the sensor, after the stirring time predicted has elapsed, determines whether the amount of change per unit time of the output value of the sensor acquired is within the first range, and determines that the developer in the casing is uniform, when it is determined that the amount of change per unit time of the output value of the sensor acquired is within the first range.

5. The image forming apparatus according to claim 4, wherein the hardware processor continues the stirring by the screw for first time, when it was determined that the change amount per unit time of the output value of the sensor is not within the first range, acquires the output value of the sensor again, after the first time has elapsed, when stirring by the screw is continued, and further determines whether the amount of change per unit time of the output value of the sensor acquired again is within the first range.

6. The image forming apparatus according to claim 4, wherein the hardware processor determines whether or not the amount of change per unit time of the output value of the sensor acquired is within a second range, predicts stirring time by the screw required to make the developer in the casing become uniform, when it is determined that the amount of change per unit time of the acquired output value of the toner concentration sensor is within the second range, and starts acquiring the output value of the sensor, irrespective of the predicted stirring time, when it is determined that the amount of change per unit time of the acquired output value of the toner concentration sensor is not within the second range.

7. The image forming apparatus according to claim 6, wherein the hardware processor notifies a warning indicating abnormality of the developing device, when it is determined that the amount of change per unit time of the acquired output value of the toner concentration sensor is not within the second range, and the amount of change per unit time of the output value acquired of the toner concentration sensor does not fall within the second range even if the stirring by the screw is continued for second time.

8. The image forming apparatus according to claim 1, wherein the hardware processor judges whether or not the developer in the casing is uniform, based on the amount of change per unit time of the output value of the sensor repeatedly acquired at a time interval equal to a stirring cycle which is a cycle in which the developer in the casing circulates in the casing by stirring of the screw.

9. A non-transitory computer-readable recording medium storing a controlling program for an image forming apparatus having a developing device and a sensor, wherein the developing device includes a casing, two-component developer accommodated in the casing, and a screw that conveys and stirs the developer in the casing in a predetermined direction by rotating, the sensor outputs a value indicative of toner concentration of the developer in the casing and the program causing a computer to execute:

judging whether or not the developer in the casing is uniform, based on an amount of change per unit time of an output value of the sensor, acquired after starting stirring of the developer in the casing by the screw.

* * * * *